US007427929B2

(12) United States Patent
Bauer et al.

(10) Patent No.: US 7,427,929 B2
(45) Date of Patent: Sep. 23, 2008

(54) METHOD AND APPARATUS FOR PREVIEWING CONDITIONS ON A HIGHWAY

(75) Inventors: James A. Bauer, Ypsilanti, MI (US); Okuda Masato, Novi, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 11/548,419

(22) Filed: Oct. 11, 2006

(65) Prior Publication Data

US 2007/0188348 A1 Aug. 16, 2007

Related U.S. Application Data

(60) Provisional application No. 60/725,967, filed on Oct. 12, 2005.

(51) Int. Cl.
*G08G 1/09* (2006.01)

(52) U.S. Cl. ..... 340/905; 340/901; 340/436; 340/471; 307/9.1; 700/300

(58) Field of Classification Search ..... 340/905
See application file for complete search history.

(56) References Cited

U.S. PATENT DOCUMENTS

| | | | | |
|---|---|---|---|---|
| 3,532,986 | A * | 10/1970 | Gelushia et al. | 340/902 |
| 3,683,328 | A | 8/1972 | Fayling | |
| 3,839,717 | A * | 10/1974 | Paul | 342/44 |
| 4,403,208 | A * | 9/1983 | Hodgson et al. | 340/902 |
| 4,706,086 | A | 11/1987 | Panizza et al. | |
| 5,289,181 | A * | 2/1994 | Watanabe et al. | 340/902 |
| 5,546,311 | A | 8/1996 | Sekine et al. | |
| 6,011,492 | A * | 1/2000 | Garesche | 340/904 |
| 6,121,896 | A * | 9/2000 | Rahman | 340/902 |
| 6,160,493 | A * | 12/2000 | Smith | 340/902 |
| 6,236,337 | B1 | 5/2001 | Beier et al. | |
| 6,249,232 | B1 | 6/2001 | Tamura et al. | |
| 6,359,552 | B1 * | 3/2002 | King | 340/436 |
| 6,445,308 | B1 | 9/2002 | Koike et al. | |
| 6,615,137 | B2 * | 9/2003 | Lutter et al. | 340/436 |
| 6,630,891 | B1 * | 10/2003 | Dilling | 340/902 |
| 6,650,252 | B2 * | 11/2003 | Miller, Jr. | 340/989 |
| 6,675,081 | B2 * | 1/2004 | Shuman et al. | 340/901 |
| 6,679,702 | B1 * | 1/2004 | Rau | 340/435 |

(Continued)

FOREIGN PATENT DOCUMENTS

| | | |
|---|---|---|
| JP | 63168813 | 7/1988 |

(Continued)

*Primary Examiner*—George A Bugg
*Assistant Examiner*—Eric M. Blount
(74) *Attorney, Agent, or Firm*—Gifford, Krass, Sprinkle, Anderson & Citkowski, P.C.

(57) ABSTRACT

Apparatus according to an embodiment of the present invention includes an advisory system that transmits information regarding the status of the host vehicle to drivers of other vehicles, in particular when the status of the host vehicle presents a hazardous condition to other vehicles. An advisory system may also receive information from other vehicles, and provide an alert to the driver of the host vehicle if a hazard to the host vehicle exists. Methods of providing such information are also described.

21 Claims, 3 Drawing Sheets

U.S. PATENT DOCUMENTS

| | | | | |
|---|---|---|---|---|
| 6,765,495 | B1 * | 7/2004 | Dunning et al. | 340/903 |
| 6,870,487 | B2 | 3/2005 | Nuesser et al. | |
| 6,985,089 | B2 * | 1/2006 | Liu et al. | 340/903 |
| 7,102,536 | B2 * | 9/2006 | Scholz | 340/902 |
| 7,106,219 | B2 * | 9/2006 | Pearce | 340/995.13 |
| 2002/0198632 | A1 * | 12/2002 | Breed et al. | 701/1 |
| 2002/0198660 | A1 * | 12/2002 | Lutter et al. | 340/903 |
| 2003/0006889 | A1 | 1/2003 | Koike | |
| 2003/0102997 | A1 | 6/2003 | Levin et al. | |
| 2004/0178926 | A1 | 9/2004 | Lee et al. | |
| 2005/0073430 | A1 * | 4/2005 | Kusters et al. | 340/901 |
| 2005/0088318 | A1 | 4/2005 | Liu et al. | |
| 2005/0131629 | A1 | 6/2005 | Ignatin | |
| 2005/0225457 | A1 | 10/2005 | Kagawa | |
| 2006/0049963 | A1 | 3/2006 | Smith | |

FOREIGN PATENT DOCUMENTS

| | | |
|---|---|---|
| JP | 63192900 | 8/1988 |
| JP | 11083998 | 3/1999 |
| JP | 20033223696 | 8/2003 |
| JP | 2004013413 | 1/2004 |
| JP | 2004164315 | 6/2004 |

* cited by examiner

METHOD AND APPARATUS FOR PREVIEWING CONDITIONS ON A HIGHWAY

REFERENCE TO RELATED APPLICATION

This application claims priority from U.S. Provisional Application Ser. No. 60/725,967, filed Oct. 12, 2005, the entire content of which is incorporated herein by reference.

FIELD OF THE INVENTION

The invention relates to a driver advisory system for use in a host vehicle.

BACKGROUND OF THE INVENTION

Information concerning the status of a vehicle on a highway is currently provided by variable advisory message signs and radio broadcasts, but these methods provide incomplete information that is inconvenient to access. Advisory message signs are typically constructed along only urban highways, are usually situated at distant intervals, and are often difficult to read. Radio broadcasts that address the status of a vehicle on a highway are provided infrequently and are supported by detection methods that are limited in nature.

Data collection and dissemination regarding the status of a vehicle on a highway currently focuses on the aftereffect that a vehicle has on surrounding traffic patterns.

In Japanese Patent laid-open Application No. 2004-78562, a communication system is disclosed for transmitting information regarding the driver's status to a remote vehicle. This patent application, however, does not disclose a system for providing an advisory message to other vehicles regarding the location of the occupants of a vehicle on a highway. Further, it does not disclose a system for providing information regarding the relative operational characteristics of a car in the same said location, and does not provide an advisory message that focuses on vehicle operations that are outside the scope of typical highway driving.

SUMMARY OF THE INVENTION

A driver advisory system is provided for use in a host vehicle. An advisory system according to an embodiment of the present invention may transmit information regarding the status of the host vehicle to drivers of other vehicles. An example advisory system associated with a host vehicle provides information related to the host vehicle to any other vehicle in the vicinity of the vehicle, such as the existence of a hazardous condition. A system may also receive such information from other vehicles.

An example driver advisory system comprises a sensor providing a sensor output related to a vehicle parameter; an electronic circuit receiving the sensor output; and a communication unit. The electronic circuit provides an output signal if the sensor output corresponds to a hazardous condition for other vehicles, and the communication unit then transmits an advisory message to other vehicles. The apparatus may further receive advisory messages from other vehicles, the electronic circuit determining if a hazardous condition exists for the host vehicle. A human-machine interface may be used to provide an alert to the driver of the host vehicle. In some embodiments, the alerts are tailored to the driving conditions, such as alerts for stopped vehicles only being provided during highway driving.

In other examples, a driver advisory system comprises a communication unit operable to receive a received advisory message including information related to a second vehicle, and an electronic circuit determining if a hazard to the host vehicle exists using information in the received advisory message. The electronic circuit provides an alert signal if a hazard is present, and a human-machine interface provides an alert to the driver when the alert signal is received from the electronic circuit.

A number of vehicle parameters related to the host vehicle may be monitored, including vehicle speed/stability thresholds, heading (compass), yaw rate, transmit power, RSSI (Received Signal Strength Indicator), airbag deployed, PRNDL (transmission gear selected), emergency brake applied, hazard lights and head/tail/parking lights status, occupant sensing, door open/close, forward looking vision and radar data, vehicle make/model/color, and highway identification, and may further determine of the instant highway location of the host vehicle. Similar information may be received from other vehicles. Vehicle headings and locations may be used to determine the relative directions and/or positions of the vehicles.

In some examples, an estimate of vehicle proximity may be determined by a receiving system associated with another vehicle, using the received strength and a known transmission strength, which may be standardized or otherwise predetermined, or signal strength data may be included in the transmitted signal itself.

The term "highway" refers to a road on which vehicles would usually progress without significant impediment, absent other traffic or unusual hazardous conditions. Hence, as used here, the term highway does not include urban routes with frequent traffic control signals, but includes limited-access roads such as freeways. In some embodiments, an advisory system only operates during highway driving, and may be activated on an entrance ramp to a highway (such as a freeway) and deactivated on exit from the highway.

A navigation system, information received from other vehicles, or other sensor data may be used to determine if a host vehicle is on a highway. For example, on and off ramps to a limited-access highway may be detected using speed and/or acceleration data, and possibly yaw rate. An advisory system may activate on an on-ramp, and de-activate on an off-ramp.

DETAILED DESCRIPTION OF THE INVENTION

Figure 1:
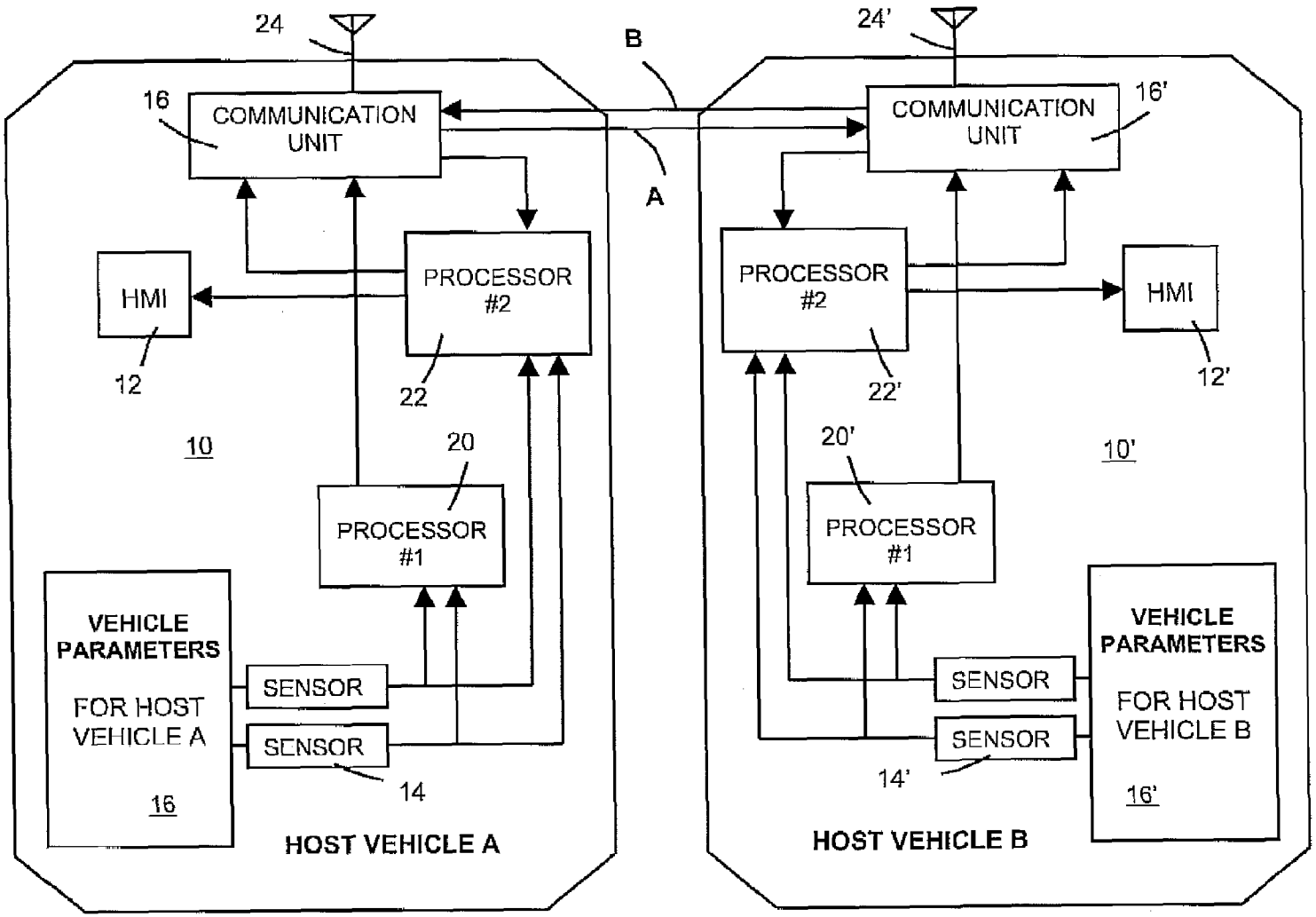
FIG. 1 is a schematic of an advisory system according to an embodiment of the invention.

Embodiments of the present invention relate to a driver advisory system for use in a host vehicle for providing an advisory message to other vehicles traveling on a highway in the vicinity of the host vehicle. A system may allow an alert to be provided to the drivers of other vehicles regarding the status of the host vehicle when the host vehicle has a non-standard vehicle status on a highway, for example one associated with a hazardous condition. As used herein, the status of the host vehicle (vehicle status) includes the presence or otherwise of the driver and/or passenger(s) within the vehicle, for example as determined using a seat occupancy sensor and/or door opening sensor.

Slow vehicle speeds, engagement of PARK mode, slow or stopped driving, door opening, and driver (or passenger) exit from a vehicle may be typical events in an urban area, side street, commercial zone, or parking lot. However, for highway driving these events are possibly indicative of a hazardous condition, and may be shared for the benefit of the driving public. Embodiments of the present invention include a driver advisory system associated with a host vehicle that provides an alert to other drivers of a possible hazardous condition due to the status of the host vehicle.

In one example, the driver advisory system includes at least one sensor, a processor, and a communication unit. The sensor, or sensors, monitor vehicle parameters related to the host vehicle. The vehicle parameter(s) may be chosen so as to be relevant to highway travel, for example vehicle parameters correlated with a hazardous condition for other vehicles on the same highway as the host vehicle. The sensors provide sensor outputs related to the vehicle parameters, allowing the vehicle status to be quantified. For example, one or more sensor outputs may indicate a hazardous vehicle status. The processor receives the sensor output(s) and determines if a hazardous condition exists. In some examples, the processor may calculate a risk factor as a function of the sensor output, the processor providing an output signal having information concerning the vehicle status if the risk factor exceeds a predetermined threshold value. In other examples, the existence of any one of certain vehicle parameters (such as an open door) is indicative of a hazardous condition. The communication unit receives the output signal from the processor and transmits the information for reception by other vehicles in the vicinity of the host vehicle.

Embodiments of the invention include a driver advisory system for use in a host vehicle, which determines if the vehicle status is correlated with a highway-related hazardous condition. The advisory system then broadcasts or transmits an advisory message regarding the vehicle status to vehicles in the vicinity of the host vehicle. The advisory system may also provide a description of the vehicle, highway position, heading, or other information related to the host vehicle.

In some examples, a driver advisory system for use in a host vehicle comprises: a sensor monitoring a vehicle parameter (such as a parameter of the host vehicle related to unusual patterns of operation while the vehicle is on a highway), and providing a sensor output; a processor receiving the sensor output and calculating a risk factor as a function of the sensor output, the processor providing an output signal having information concerning the status of the host vehicle in response to the risk factor exceeding a predetermined threshold value; and a communication unit receiving the output signal from the processor and transmitting the information for retrieval by the other vehicles in the vicinity of the host vehicle. The communication unit receives an output signal from the processor and transmits the information concerning the highway position and status of the vehicle. The communication unit may also receive advisory messages transmitted from a second vehicle regarding the highway location and status of the second vehicle.

A plurality of sensors may be used for sensing a plurality of vehicle parameters related to the host vehicle. The vehicle parameters may include one or more of the following: vehicle speed, vehicle speed/stability threshold ratio, heading (e.g. compass direction), yaw rate, transmit power, RSSI, airbag deployment status, PRNDL (gear selection), emergency brake applied, hazard light operation, head/tail/parking lights status, seat occupancy (passenger(s) and/or driver), door open/close status, vision data (such as forward-looking vision data), radar data, highway identification, absolute position (e.g. latitude and longitude), relative position (from a reference position) vehicle make/model/color, and highway identification.

Some data may be stored, and stored (historical) data transmitted with current data. This allows other vehicles to predict behavior of the host vehicle, and to better estimate risks. Stored data may include vehicle speed, threshold data, yaw rate, heading, transmit power, RSSI, highway identification, and/or absolute position.

Sensors may include one or more of the following: switch-based sensors, force/weight sensors, inductive sensors, vision-based sensors, radar sensors, capacitive sensors, sensors that detect digital data stored on microprocessor memory, and the like. A navigation system (such as a global positioning system) may be used to determine an instant location of the host vehicle.

A system may also include a second processor that receives a signal from the communication unit concerning the position and heading of the second vehicle, allowing the second processor to calculate the position and differential location change of the host vehicle relative to the second vehicle. (This function and others may alternatively be performed by a single processor). The second processor provides an alert signal in response to a determination that the host vehicle is approaching the second vehicle based on the differential location change. A human-machine interface (HMI) receives the alert signal from the second processor and providing information to the driver of the host vehicle regarding the location of the second vehicle. The human machine interface receives the alert signal from the second processor and provides an alert to the driver of the host vehicle regarding and status of the vehicle. The output signal from the first processor may include information regarding make and model of the host vehicle, and the like.

A method of transmitting to drivers of other vehicles information regarding the status of a host vehicle and its occupant comprises: monitoring the status of the host vehicle; providing an output quantity the status of the host vehicle; calculating a risk factor as a function of the output; and transmitting the information concerning the status of the host vehicle for retrieval by the other vehicles in the vicinity of the host vehicle This transmission may occur when the risk factor exceeds a predetermined threshold value.

Information concerning the location and status of the host vehicle may be transmitted for retrieval by the other vehicles in the vicinity of the host vehicle, for example in response to a risk factor exceeding a predetermined threshold value. Advisory messages may also be transmitted from a second vehicle regarding the status of the second vehicle, and received by the host vehicle.

A system may determine if the host vehicle is approaching or moving away from the second vehicle. The driver of the host vehicle may be provided with an alert in response to the host vehicle's movement toward the second vehicle.

A method of transmitting and processing information regarding the status of a second vehicle comprises: determining the instant location of the host vehicle; receiving advisory messages transmitted from a second vehicle regarding the status of the second vehicle, and a highway position and heading of the second vehicle; calculating the change of location of host vehicle with respect to the second vehicle; and providing to the driver of the host vehicle an alert in response to the determination that the host vehicle is approaching the second vehicle.

It can be determined if the host vehicle is approaching a vehicle that is transmitting information by monitoring the RSSI (Received Signal Strength Indicator). A vehicle passing the host vehicle includes can be detected by detecting a received signal strength peak. The received signal will peak at the passing point for transmitting and receiving vehicles heading in an opposed (or a similar) direction. A received strength may also be used to estimate vehicle proximity. A received signal strength above a certain threshold may also be used to trigger transmission of information.

Host vehicle entrance on to a highway can be detected by monitoring the history of speed, compass heading and/or yaw rate of the host vehicle. A method of knowing that a vehicle that is sending the information is on a highway includes estimating the highway path using data collected from other vehicles.

Embodiments of the present invention also include a method of transmitting an advisory message for retrieval by other vehicles in the vicinity of the host vehicle in such a way that the channel is not overloaded with advisory messages. The information that is periodically transmitted from vehicles can be selected so as to optimize the channel usage and to avoid unnecessary processing, for example by selecting information for transmission (and/or number or duration of transmissions) based on risk factors associated with various conditions.

An example advisory system according to an embodiment of the present invention is generally indicated at 10 in FIG. 1. The advisory system is associated with a host vehicle (host vehicle A in FIG. 1), and includes at least one sensor 14 for sensing a vehicle parameter of the host vehicle.

In this example, a plurality of sensors is used for sensing vehicle parameters, such as parameters relevant to highway travel. Sensors may be any type of suitable sensor known by those of ordinary skill in the art, such as switch-based sensors, force/weight sensors, inductive sensors, vision sensors, radar sensors, capacitive sensors, and sensors that detect digital memory. Each sensor provides a sensor output related to one or more vehicle parameters.

A first processor 20 receives the sensor outputs provided by the sensors. The first processor 20 calculates a risk factor as a function of the sensor outputs, and provides an output signal in response to the risk factor exceeding a predetermined threshold value. The output signal includes information concerning the highway status of the host vehicle.

A communication unit 16 receives the output signal from the first processor. The communication unit 16 transmits an advisory message (shown as arrow A) for retrieval by other vehicles in the vicinity of the host vehicle. This may be termed a "highway local preview alert". In this example, the communication unit 16 is a dedicated short-range communication device having a receiver and transmitter, as known by those of ordinary skill of the art. An antenna 24 may be mounted on the vehicle. The communication unit can, for example, communicate via a radio frequency, low or high band frequencies, Zigbee, 802.11-based protocol, other wireless personal area network protocol, or other wireless protocol. In some examples, a dedicated short range communication system is used having a transmission range of less than 1000 m.

The advisory message can either be broadcast a single time (e.g. low vehicle speed) or at intervals (for example when a sensor indicates a hazardous status, such as when vehicle is in PARK or a door open).

The advisory system may also receive advisory messages (indicated by arrow B) transmitted from a second vehicle (host vehicle B) in the vicinity of host vehicle. Received advisory messages may be advisory messages from one or more other vehicles in the vicinity of the host vehicle. In this example, the communication unit 30 receives advisory messages transmitted from the second vehicle, indicative of vehicle parameters related to the second vehicle, such as highway position and heading of the second vehicle.

The communication unit 30 provides a signal to a second processor 22 containing information received from the second vehicle. The second processor also receives sensor outputs from sensors 14 and the signal from the communication unit 16, and calculates the distance and position of the host vehicle relative to the second vehicle. These calculations may be substantially instantaneous and continuous.

The distance and position of the host vehicle relative to the second vehicle can be determined using historical data, and may include vehicle speed, compass heading, yaw rate, transmit power, RSSI, the time/location of vehicles passing on the same side and on the opposite side of the highway, and vehicle identification (such as a temporary ID associated with the vehicle). Data such as that discussed above can also be periodically sent out from all vehicles. To optimize channel usage and to avoid unnecessary processing, a host vehicle may select appropriate data for transmission, such as only information related to a hazardous condition, or information filtered on the basis of associated risk factor.

The second processor 22 provides an alert signal regarding the highway status of second vehicle. A human machine interface 12 receives the alert signal and provides information regarding the second vehicle to the driver of the host vehicle. This information may include the distance and position of host vehicle B relative to the host vehicle. The human machine interface 12 also provides an advisory message to the driver regarding the highway status of second vehicle.

The second processor 22 can also initiate a rebroadcast of the information received from vehicle B, for example in cases when the host vehicle is traveling on the opposite side of the highway relative to the second vehicle. The number of rebroadcasts may be limited to a number and interval that is sufficient for informing vehicles that are approaching second vehicle, without flooding the channel with repetitive advisory messages from many vehicles. The second processor may be able to determine if other vehicles have already rebroadcast the advisory message from second vehicle via information provided within the contents of the advisory message. If there is no evidence of having received a rebroadcast of the advisory message from the second vehicle, the second processor initiates a rebroadcast once an appropriate distance is established between host vehicles A and B (host vehicle and second vehicle), and/or when the original advisory message from second vehicle is no longer detected by host vehicle.

Figure 2:
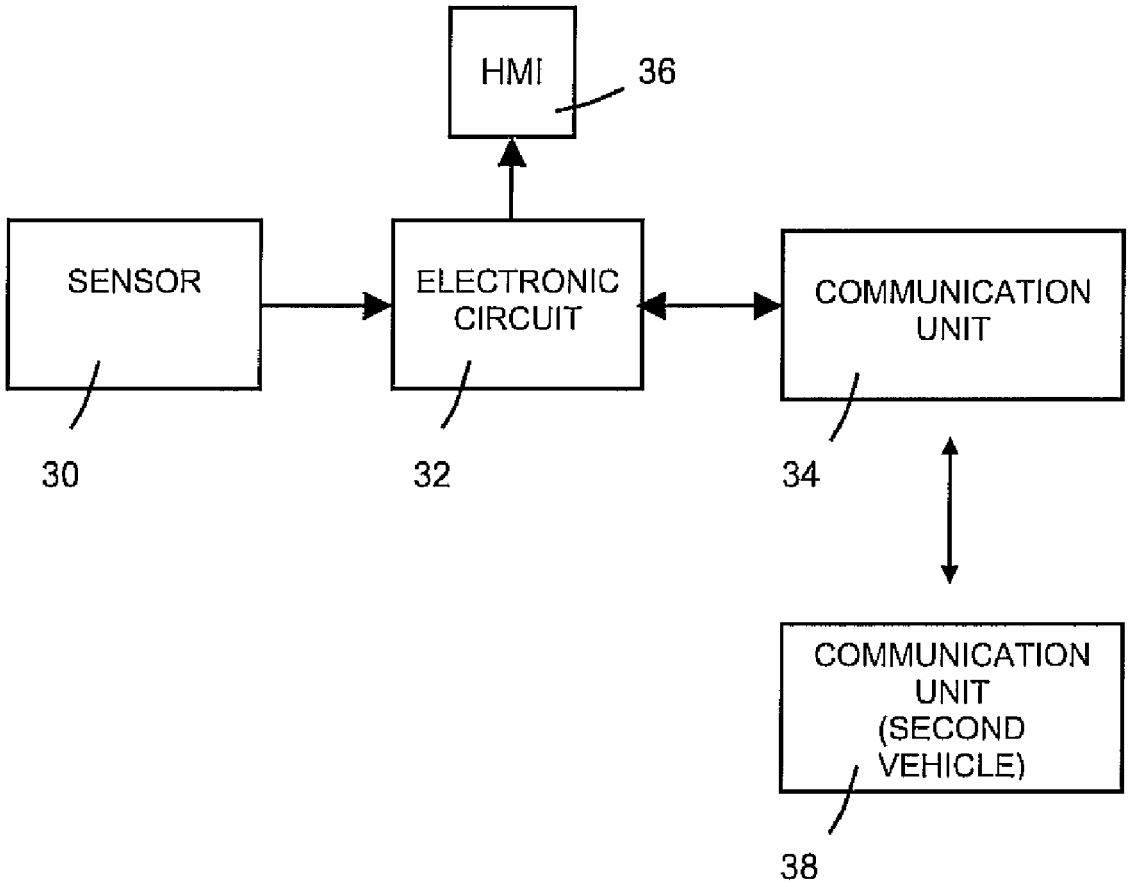
FIG. 2 is another schematic of an advisory system according to an embodiment of the invention.

FIG. 2 illustrates another schematic of an advisory system. The system comprises sensor 30, electronic circuit 32, communication unit 34, and human machine interface 36. The communication allows transmission to and reception from a communication unit associated with another vehicle (38), as illustrated by the double headed arrow. The electronic circuit may include one or more processors, for example as shown in FIG. 1. The electronic circuit may include logic or other circuitry, for example so as to provide an output signal to the communication unit when a vehicle status corresponding to a hazardous condition is detected. The electronic circuitry may further include memory (for example, for historical data), and a clock (for time data).

The sensor 30 provides a sensor output to the electronic circuit. If the electronic circuit determines that the host vehicle status is hazardous condition for other vehicles, an output signal is provided to the communication unit, which transmits an advisory message. The communication unit also receives advisory messages from other vehicles. If the electronic circuit determines that an advisory message from a second vehicle corresponds to a hazardous condition for the host vehicle, an alert signal is sent to the HBI, and the driver of the host vehicle receives an alert (e.g. visual, audio, and/or haptic alert).

A communication unit may receive information from other vehicles, and also from other sources, such as road-side sensors, wide area networks (such as the Internet), and the like.

Figure 3:
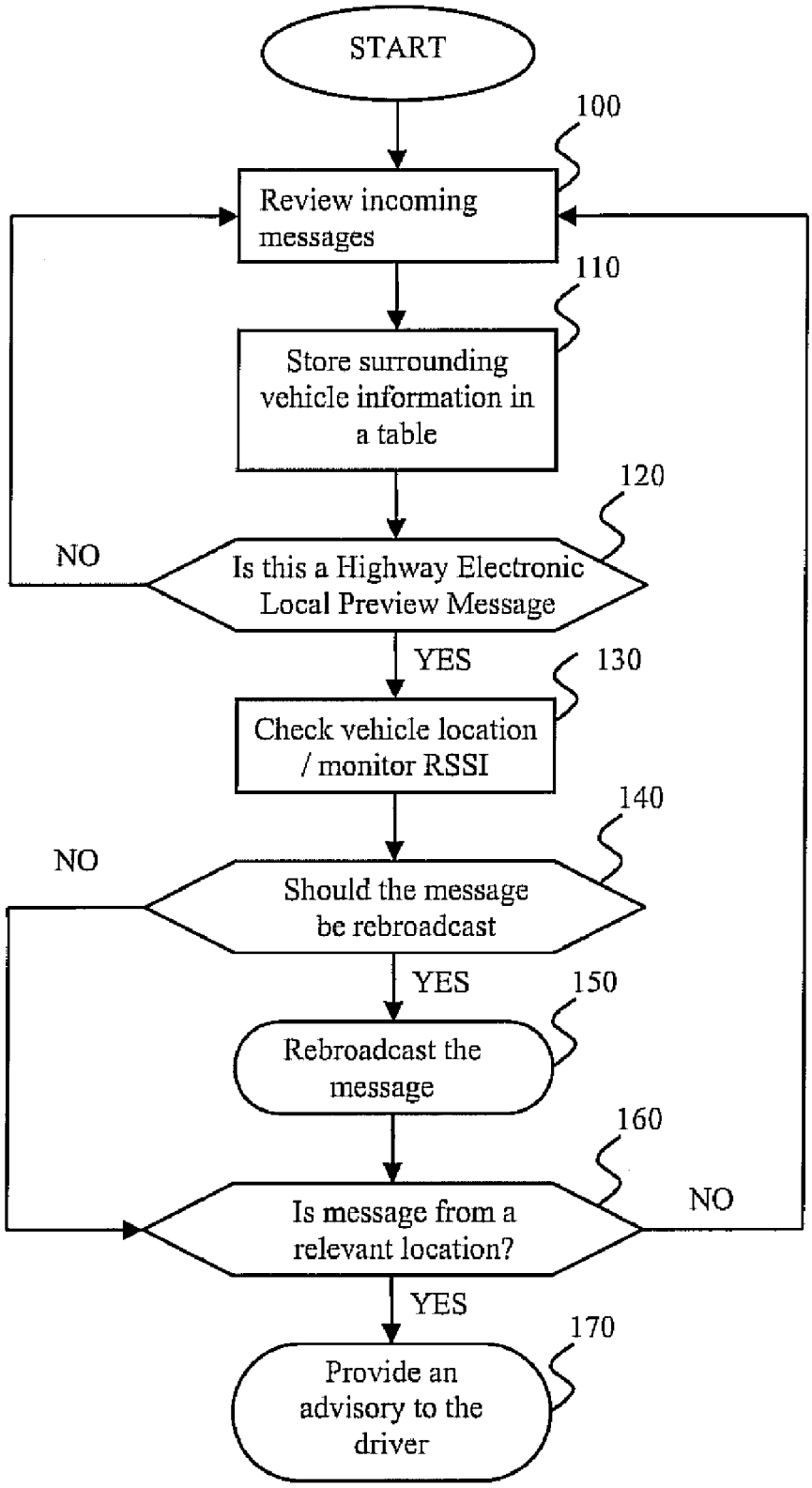
FIG. 3 is a flowchart describing a mode of operation of an advisory system according to an embodiment of the invention.

FIG. 3 shows a flowchart for a mode of operation of an advisory system, such as the system 10 discussed above in relation to FIG. 1. In this example, the advisory system within a host vehicle continuously monitors for advisory messages. These may be advisory message from other vehicles in the vicinity of the host vehicle, allowing the driver of the host vehicle to be warned of potential hazards. The system reviews (100) all incoming advisory messages from other advisory systems in the vicinity of the vehicle. Information relating to at least a second vehicle in the vicinity of the host vehicle is stored (110) in a table. The system determines (120) if any of the incoming advisory messages are advisory messages provided by a second vehicle. If the advisory message is not an advisory message, the system continues to review incoming advisory messages. If the advisory message is an advisory message, then the system checks (130) the current location of the host vehicle and determines if the host vehicle is traveling on the same highway, and if so, in the same or opposite direction of travel as the second vehicle. The system checks the advisory message contents to determine (140) if the advisory message is appropriate for rebroadcast (the second vehicle is on the opposite side of the highway, etc.). If the advisory message is appropriate for rebroadcast, the system waits until a threshold range is reached and the applicable advisory message is no longer being received, then the system rebroadcasts (150) the advisory message.

If the advisory message is not appropriate for rebroadcast, the system determines (160) whether the host vehicle is approaching or moving away from the second vehicle. If the host vehicle is moving away from the second vehicle, so that the second vehicle is not at a relevant location, then the system continues to review the incoming advisory messages. If the host vehicle is approaching the second vehicle on the same highway and in the same direction of travel, then the system provides (170) an advisory alert to the driver of the host vehicle relating to the location and status of the second vehicle.

Sensors

An example advisory system comprises a plurality of sensors, a communication unit (such as a DSRC unit), a processor, and a human-machine interface (HMI). The sensors provide sensor outputs, allowing detection of non-standard vehicle operation. Sensors may already be used for other vehicular systems, and the information from these sensors can be provided via an existing LAN within the host vehicle. A system according to an embodiment of the present invention may include one or more sensors, such as those discussed below.

A compass provides vehicle heading to the processing unit. It can be used to determine if a vehicle with the problem is heading in the same direction as another vehicle, or not.

A speed sensor provides vehicle speed to the processing unit for traffic slow-down application. It may also used for freeway entrance and exit detection. An acceleration sensor (G sensor) provides vehicle acceleration and deceleration to the processing unit, and may be used for a traffic slow-down advisory.

A yaw-rate sensor provides vehicle yaw-rate to the processing unit. This can be used for freeway entrance and exit detection, spin-out or other loss of control, and hence can be used to provide a spin-out advisory.

A door open/close sensor detects the door open/close status. It can be used for an unseated occupant advisory, for example if a door has been opened recently, since the vehicle entered a highway, or while the vehicle was close to its present location. A seat sensor detects the presence or absence of an occupant, and can also be used for unseated occupant advisory.

An airbag sensor detects airbag deployment, possibly indicative of a collision. It can be used for an airbag deployment advisory.

A shift switch provides the shift position, a tire pressure sensor detects a low tire pressure, a hazard light sends a sensor output when turned on by a driver, and an engine overheat sensor provides an engine overheat signal. Some or all of these sensor outputs may be used for a parked vehicle advisory.

Communication Unit

The communication unit may be a Dedicated Short range Communication (DSRC) unit, and a 5.9 GHz DSRC antenna may be installed on the vehicle. The communication unit transmits information to the surrounding vehicles, for example providing information related to the existence of a non-standard vehicle status, such as a stopped vehicle on a highway. Depending on the vehicle status, transmission can be periodic or short-term. The communication unit can also receive information from other vehicles, and reception may be always active.

The communication unit may also receive information from other sources, such as wireless communications from sources other than other vehicles. Information received may include travel conditions, weather reports, and the like.

Electronic Circuit

The electronic circuit may include one or more processors, such as the two processor circuit shown in FIG. 1. A processor may be a stand-alone Engine Control Unit (ECU), which may be integrated with a vehicle audio system and/or navigation system.

In an example method of operation, the electronic circuit detects freeway entrance and exit, for example by monitoring vehicle speed, yaw-rate and compass heading. A navigation system, such as a GPS, may also be used to identify highways. Navigation system equipped vehicles can also provide highway travel information to other nearby vehicles by broadcasting a low-power advisory message to them.

In some embodiments, the electronic circuit determines a risk factor associated with the status of the host vehicle, using the sensor outputs provided by the sensors. If the risk factor is higher than a threshold value, an output signal is sent to the communication unit. The electronic circuit unit may further calculate the risk factors associated with the other vehicles, using information, such as advisory messages, received by the communications unit. An alert signal is sent to the interface, which provides an alert to the driver, if advisable.

Risk factors may be associated with one or more vehicle parameters, and stored in a memory. Risk factors may be used to determine if an advisory message, driver alert, or particular alert type is provided.

Human-Machine Interface

A human-machine interface (HMI) may be used to alert the driver of the host vehicle about hazardous conditions associated with other vehicles, for example non-standard operations such as parking on a highway. The interface may be configured in various ways, for example as according to a driver preference. Alert types may be selected by the driver to avoid distraction.

In one example, the interface comprises an audio device and a lamp, such as an LED. An audio alert and/or a visual alert (e.g. a LED indicator on the meter cluster) alerts the driver. More hazardous conditions, such as airbag deployment and vehicle spin-out, may be conveyed by an audio alert, whereas less urgent alerts such as vehicle slow-down may be only visual. Alerts may be configured as a function of driver preference.

In another example, an audio device and a display unit such as navigation system provide audio and/or visual alerts to the driver. In one example, more hazardous conditions such as airbag deployment and vehicle spin-out (associated with a higher risk factor) lead to both alert types being given, whereas a less urgent alert such as vehicle slow-down (associated with a lower risk factor) may only lead to a visual alert.

Alert display and type may be modified by driver preference. In some examples, driver preference may not be used to disable warnings of the most hazardous conditions.

System Operation

The electronic circuit detects a non-standard operation by monitoring information from various sensors installed on the vehicle. The processing unit sends a command to a communication unit (such as a DSRC transceiver) to broadcast the non-standard status to other vehicles within DSRC transmit range.

Other broadcast items may include vehicle ID, transmit power, GPS latitude/longitude, timestamp of first advisory message, vehicle color, vehicle type (e.g. sedan, SUV, minivan, commercial vehicle, emergency vehicle, truck, etc.), vehicle speed thresholds, sampling of relevant historical data (such as compass, yaw rate, and the like). Broadcast items may include alerts such as flat tire, engine overheat, door open, no vehicle occupant, airbag deployment, and the like to warn of possible danger. Vehicle speed thresholds may be based on general speed ranges (e.g. below 55 mph, below 45 mph, below 5 mph, etc.), depending on the speed-limit highway, weather, vehicle type, and/or or other status.

A second system, possibly similar to that of the host vehicle, on a second vehicle receives the information, and an electronic circuit of the second system determines if the information is coming from a vehicle on the same side of the highway, and also if the second vehicle is approaching the host vehicle. If so, the electronic circuit sends a command to the HMI of the second vehicle to alert the driver about a hazardous condition.

Comparison of the compass headings of the host vehicle and the second vehicle allows the system to determine whether broadcast information comes from a vehicle on the same side or opposite side of the highway. A GPS comparison or monitoring the RSSI (Received Signal Strength Indicator) allows the system to determine whether a receiving vehicle is approaching a transmitting vehicle. Received information can be re-broadcast by vehicles passing on the opposite side of a sending vehicle to increase effective transmission range. A vehicle may only re-broadcast if it has not received the same information from other vehicles, to avoid unnecessary, repetitive broadcasting.

Unseated Occupant Advisory

An unseated occupant advisory alerts other drivers if any occupant of a vehicle has left their seat and exited the vehicle. The advisory may only be given for vehicles on or along the highway ahead. Typical hazardous conditions are when a driver exits a vehicle to open the hood, check for a tire puncture, for another reason related to vehicle problem, or if traffic is completely stopped, and there are benefits to be gained by informing other vehicles of such conditions.

An example vehicle alert is: "A person ahead has left a red minivan. The driver door is ajar." In this example, the second vehicle transmits a vehicle description and an alert based on an open door.

An electronic circuit, such as a processor, may implement one or more algorithms to determine if a hazardous status is present. Algorithms for unseated occupant alerts may include the following:

Vehicle speed<Threshold speed,

Seat occupant signal=HIGH to LOW (occupied to unoccupied),

Door Closed/Open signal=HIGH to LOW,

Transmit algorithms may include:

Vehicle speed<Threshold speed,

Seat occupant signal=LOW (for seats that have been HIGH), and

Door Closed/Open signal=LOW (for doors that have been HIGH).

Traffic Slow-Down Advisory

This advisory message alerts other drivers if a vehicle slows down on the highway ahead, which may indicate of congested traffic or other hazardous condition. An alert may only be provided if the deceleration of vehicles ahead is greater than a threshold value. The possibility of a rear end collision may be reduced by the alert.

Because there may be many vehicles slowing down, the broadcast may be short-term to avoid flooding the transmission channel. The number of vehicles slowing down may be determined to indicate the size of congestions.

The alert may provide information on the deceleration, and the alert may be enhanced if the deceleration is above a second threshold level.

Example: "12 cars are quickly slowing down ahead!"

Detection algorithms may include:

(Vehicle speed<Threshold1) & (deceleration>Threshold1') for less hazardous conditions (marginal cases), and (Vehicle speed<Threshold2) & (deceleration>Threshold2') for more hazardous cases. Here, the second deceleration threshold (Threshold2') is greater than the first deceleration threshold (Threshold1').

Transmit algorithms may include the following:

(Vehicle speed<Threshold1) & (deceleration>Threshold1') & (Time counter after detection<Transmit duration1), (Vehicle speed<Threshold2) & (deceleration>Threshold2') & (Time counter after detection<Transmit duration2)

Airbag Deployment Advisory

This alerts other drivers if an airbag has been deployed. An example detection algorithm is:

Airbag deployment signal=HIGH to LOW (depending on sensor configuration).

The transmit algorithm may be:

Airbag deployment signal=LOW (for airbags that have been HIGH)

Vehicle Spin-Out Advisory

This is to alert other drivers if a vehicle on the highway up ahead has experienced a spin-out due to a wet or icy road.

The detection algorithm may be:

(Yaw rate>Threshold1) & (compass heading>Threshold1') & (vehicle speed<Threshold1")

The transmit algorithm may be:

(Yaw rate>Threshold1) & (compass heading>Threshold1') & (vehicle speed<Threshold1")

Parked Vehicle Advisory

This is to alert other drivers if a vehicle is parked on or alongside a highway. Usually vehicles with engine malfunction or flat tires park on the shoulder, giving rise to a hazardous condition.

Example audio alert: "Blue pick-up truck with a flat tire is parked ahead"

The detection algorithm may be:

PARK shift signal=HIGH

The transmit algorithm may be:

PARK shift signal=HIGH

Freeway Entrance Detection

Parked vehicles and slow traffic are very common on urban side roads, hence in some embodiments an advisory system according to the present invention only operates when the host vehicle is on a highway, such as a limited-access road such as a freeway, or other divided or multilane highway. The system may detect entrance and exit from a freeway, activating on entrance and deactivating on exit.

A typical freeway entrance is a curved ramp and vehicles progressively gain speed while they are on the ramp. This pattern may be detected from sensor outputs, and can be used for entrance detection. The vehicle speed, acceleration, yaw-rate and compass heading are monitored and compared with a typical entrance pattern. Freeway exit typically shows a reverse pattern. Vehicles progressively reduce their speed while they are on the curved ramp. The vehicle speed, acceleration, yaw-rate and compass heading are monitored and compared with a typical exit pattern. Once the host vehicle has exited a freeway, the system may be deactivated. Table 1 below summarizes a possible scheme for activation and deactivation. Highway position determination may further use compass data and/or peak RSSI measurements.

TABLE 1

| | Speed | Acceleration | Yaw rate |
|---|---|---|---|
| Neighborhood travel | Low | Variable | Variable |
| Arterial road travel | Low | Variable | Variable |
| Entrance ramp | Increasing | Sudden burst | Steady curves and grades |
| Exit ramp | Decreasing | Sudden decay | Steady curves and grades |
| Highway travel | High | Low | Low |

Straight entrance ramp scenarios may initialize the system when vehicles reach typical highway speed and additionally (or optionally), if a low power query signal is confirmed from a nearby vehicle traveling on the same highway. Other vehicles on the highway may have experienced the typical entrance ramp characteristic and can share the knowledge of their position with straight entrance vehicles.

False detection on non-freeways due to high speed limit can be avoided as the query signal for confirmation from vehicles traveling on the same roadway may not be returned in this case. No vehicles on this type of road experience the entrance ramp characteristic, therefore the system may remain OFF despite high vehicle speed.

A false advisory signal (e.g. traffic slow-down) from vehicles exiting off the highway from a straight exit ramp can be disqualified by passing vehicles that have remained on the highway. Comparison of compass and yaw rate history data may show that the signaling vehicle has not taken the same path as those that have remained on the highway. When the transmitting vehicle receives this correction from other vehicles, it can rebroadcast the correction to other vehicles about to exit on that same straight ramp.

False detection due to slow speed on curves may be avoided using the yaw rate signal to disqualify an advisory that occurs due to slow speed on curves, e.g. during a change from one highway to another. In these instances, the increase in speed once the vehicle has left the curve and moved onto the new highway would signify that this is a typical characteristic of the local highway configuration as opposed to the traffic situation at that particular time and location.

Areas where multiple freeways extend on parallel paths are very rare, but in these cases, vehicles equipped with navigation systems can be authorized to identify this circumstance to other vehicles in their immediate area. A "highway ID" can be given to nearby vehicles through a low power broadcast, allowing those vehicles to know the highways they are currently traveling on.

Vehicles with navigation functionality may assist other vehicles that have not yet determined if they are on a highway. For example, a vehicle that has experienced a flat tire just before entering a highway may be uncertain of its location if it is parked along the highway shoulder. The advisory message sent can identify its uncertain positional status to other vehicles, and another step can also be taken to confirm whether or not the vehicle is actually on a highway. By varying the transmit power of the advisory message, the sending vehicle can allow navi-equipped (navigation system equipped) vehicles passing by to notify whether or not the sending vehicle is on the same highway as the navi-equipped vehicle. Navi-equipped vehicles receiving the advisory message can inform the sending vehicle that the advisory message was received at a range close enough to confirm that the sending vehicle is very likely on the same highway as the navi-equipped vehicle.

Risk Factors

In some embodiments of the present invention, an electronic circuit determines a risk factor based on sensor outputs. The risk factor is compared with a threshold value, and an advisory message is transmitted if the risk factor is greater than the threshold value.

The risk factor may include various factors. Numerical values may be assigned to vehicle parameters, with higher values indicating a higher risk. For example, airbag deployment, spin-out, and unseated occupant advisories may be highest risk, a stopped vehicle advisory (transmission in park, or vehicle speed being substantially zero) may be high risk, and a low vehicle speed advisory may be lower risk. Actual numerical parameters may be assigned to risk factors, or certain vehicle parameters grouped into two or more categories.

Certain vehicle parameters may always lead to transmission of the advisory message (such as airbag deployment), for example by assigning a numerical value higher than the threshold value to such vehicle parameters.

Similarly, a second risk factor may be calculated for an advisory message received from a second vehicle. This may include numerical values assigned to the vehicle parameters of the second vehicle, as well as contributions from vehicle parameters of the host vehicle. For example, the speed of the host vehicle may be factor that increases the second risk factor, for example as a multiplying factor. The second risk factor may also be influenced by the relative location and heading (compass) of the two vehicles. The provision of an alert to the driver of the host vehicle, and the form of alert, may depend on the value of the second risk factor.

Relative Distance Determination

In cases when the relative distance between a sending vehicle and a receiving vehicle cannot be determined through a comparison of GPS data, the relative distance between the vehicles can be calculated with the help of an equipped car traveling on the opposite side of the highway. For example, consider a southbound vehicle passing by a northbound vehicle that is sending an advisory message. The southbound vehicle can determine the closest passing point by monitoring the RSSI values of the broadcast. When the closest passing point is determined (for example, from the peak signal strength), the southbound car may begin two activities: 1) rebroadcast of the original advisory, and 2) broadcast of the distance traveled since reaching the point of closest passing. Northbound vehicles approaching the first sending vehicle can similarly determine the closest passing point of the southbound vehicle that is re-broadcasting the original advisory signal. The distance traveled by the southbound vehicle may be roughly equivalent to the distance between the northbound sending vehicle and the northbound receiving vehicle.

A combination of peak RSSI (received signal strength) and heading information for the host vehicle and the second vehicle may be used to determine a close passing point, opposed headings indicating vehicles that are traveling in opposite directions.

Highway Transmission

Embodiments of the present invention include a vehicle-to-vehicle communication system which permits the vehicles communicating to determine the closeness of the vehicles to each other using a signal strength indication. In some examples, the system operates only on highways, and is disabled on urban arterial roads, service drives, and the like.

In one example, an improved vehicle proximity detection method includes determining if a host vehicle is on a highway. This can be achieved using an on-board navigation system, but other methods could be used, for instance using vehicle speed, yaw rate, and the like.

Once the system determines that the host vehicle is on a highway, the host vehicle begins transmitting a "highway signal." The highway signal comprises a data transmission at intervals, such as a periodic transmission. The transmission power may be based on a typical or known width of the highway. The highway signal may also include information concerning the power at which the signal is being transmitted, which may be transmitted as a packet.

A second vehicle traveling in the vicinity of the host vehicle detects a signal a received signal strength indication (RSSI) due to the highway signal transmitted by the host vehicle. By measuring a received signal strength, comparing it to the power at which the signal is transmitted (which may be a standard power level or encoded in the highway signal), and determining or assuming the width of the highway, the second vehicle can determine the proximity of the host vehicle.

Hence, by transmitting data that includes the power at which the data is being transmitted, other receiving vehicles can monitor the signal strength received so as to determine the proximity of transmitting and receiving vehicles.

A highway signal can used to transmit information related to the location of the host vehicle on a highway, which then can be used by other vehicles to discover they are on a highway. In one example, a host vehicle determining, with high probability, that it is on a highway starts transmitting a highway signal. For example, the host vehicle may have a navigation system. The transmit power may be based on a typical or known width of a highway (being stronger for a wide highway), and the transmit power information may be included in the signal. If a second vehicle detects the signal with sufficient strength (for example, greater than a threshold), this information can be used by the second vehicle to determine that it is on a highway. The receive signal threshold may depend on the transmitted power. The second vehicle may then use the determination that it is on a highway to activate a highway advisory system.

The highway signal may be deactivated when the host vehicle leaves the highway. A similar signal may be used on any road for location or vehicle proximity determinations.

Detection by Autonomous Sensing Vehicles

Vehicles with autonomous sensing functionality such as Pre-Crash System (PCS) and Lane Keeping Assist (LKA) have the ability to supplement the conventional detection method by detecting non-equipped vehicles, their unseated occupants, and also pedestrians without vehicles. Upon detecting an unusual event (e.g. a pedestrian walking along the highway shoulder), a vehicle with an autonomous sensing system can broadcast the information to other approaching vehicles in a surrogate manner.

The invention has been described in an illustrative manner. It is, therefore, to be understood that the terminology used is intended to be in the nature of words of description rather than of limitation. Many modifications and variations of the invention are possible in light of the above definition. Thus within the scope of the appended claims, the invention may be practiced other than as specifically described.

The invention is not restricted to the illustrative examples described above. Examples are not intended as limitations on the scope of the invention. Methods, apparatus, electrical circuits, and the like described herein are exemplary and not intended as limitations on the scope of the invention. Changes therein and other uses will occur to those skilled in the art. The scope of the invention is defined by the scope of the claims.

Having described our invention, we claim:

1. An apparatus associated with a host vehicle, the apparatus providing information related to the host vehicle, the apparatus comprising:

a sensor, the sensor providing a sensor output related to a vehicle parameter;

an electronic circuit, receiving the sensor output, and determining if the host vehicle provides a hazardous condition to other vehicles using the sensor output, and providing an output signal if the hazardous condition exists; and a communication unit, the communication unit transmitting an advisory message on receiving the output signal from the electronic circuit, the advisory message including information related to the vehicle parameter, the electronic circuit being further operable to determine if the host vehicle is on a highway, the advisory message being transmitted only if the host vehicle is on the highway, the advisory message further including transmitted power data related to the transmitted power of the advisory message, whereby a receiving system associated with another vehicle can estimate proximity to the host vehicle using a received signal strength and the transmitted power data.

2. The apparatus of claim 1, the electronic circuit using vehicle speed data and vehicle acceleration data to determine if the host vehicle is on the highway.

3. The apparatus of claim 1, wherein the vehicle parameter is selected from a group of vehicle parameters consisting of:

speed, acceleration, yaw rate, airbag deployment status, transmission gear selection, emergency brake status, hazard light status, head/tail/parking lights status, seat occupancy, and door open/close status.

4. The apparatus of claim 3, wherein the advisory message further includes the heading of the host vehicle.

5. The apparatus of claim 3, wherein the advisory message further includes the location of the vehicle.

6. An apparatus associated with a host vehicle, the apparatus providing information related to the host vehicle, the apparatus comprising:

a sensor, the sensor providing a sensor output related to a vehicle parameter;

an electronic circuit, receiving the sensor output, and determining if the host vehicle provides a hazardous condition to other vehicles using the sensor output, and providing an output signal if the hazardous condition exists; and a communication unit, the communication unit transmitting an advisory message on receiving the output signal from the electronic circuit, the advisory message including information related to the vehicle parameter, the electronic circuit being further operable to determine if the host vehicle is on a highway, the advisory message being transmitted only if the host vehicle is on the highway, wherein the advisory message includes a seat occupancy status of the host vehicle.

7. The apparatus of claim 1, wherein the advisory message includes a spin-out status of the host vehicle, the sensor being a yaw-rate sensor.

8. The apparatus of claim 1, wherein the advisory message includes current and historical values of the vehicle parameter.

9. The apparatus of claim 1, wherein the advisory message has a transmission range of less than one kilometer.

10. The apparatus of claim 1, wherein the communication unit is a wireless transceiver, the wireless transceiver further being operable to receive a received advisory message from a second vehicle in the vicinity of the host vehicle.

11. The apparatus of claim 10, wherein the apparatus further comprises a human-machine interface, the electronic circuit determining if a hazard to the host vehicle exists using the received advisory message, and providing an alert signal if the hazard to the host vehicle exists, the human-machine interface providing an alert to the driver of the host vehicle on receiving the alert signal from the electronic circuit.

12. The apparatus of claim 1, the apparatus further being in communication with a vehicle navigation system, the vehicle navigation system providing a vehicle location and a vehicle heading, the vehicle location and the vehicle heading being included in the advisory message.

13. An apparatus associated with a host vehicle, the apparatus providing an alert to the driver of the host vehicle related to a hazard, the apparatus comprising:

a communication unit, the communication unit operable to receive a received advisory message, the received advisory message including information related to a second vehicle;

an electronic circuit, receiving signals from the communication unit, the electronic circuit determining if a hazard to the host vehicle exists using the information in the received advisory message, the electronic circuit providing an alert signal if the hazard is present, the electronic circuit using a received signal strength of the received advisory message to determine a distance to a source of the received advisory message; and a human-machine interface, providing an alert to the driver of the host vehicle when the alert signal is received from the electronic circuit.

14. The apparatus of claim 13, further including a sensor, the sensor providing a sensor output related to a vehicle parameter;

wherein the electronic circuit is further operable to receive the sensor output, determine if a hazardous condition exists using the sensor output, and provide an output signal if the hazardous condition exists, the communication unit transmitting an advisory message when the output signal is received from the electronic circuit, the advisory message including one or more vehicle parameter of the host vehicle.

15. The apparatus of claim 14, wherein the electronic circuit receives a host vehicle heading from the sensor and a second vehicle heading from the received advisory message.

16. A method of providing information related to a host vehicle to other vehicles so as to warn of a hazardous condition;

determining if the host vehicle is on a highway;

sensing at least one vehicle parameter of the host vehicle;

determining if the host vehicle provides a hazardous condition to other vehicles; and transmitting an advisory message if the vehicle parameters are correlated with a hazardous condition to other vehicles, the advisory message including the vehicle parameters, the advisory message providing information related to the host vehicle to other vehicles, the advisory message only being transmitted when the host vehicle is on a highway, wherein determining if the host vehicle provides a hazardous condition includes determining if an occupant of the host vehicle has left the host vehicle.

17. The method of claim 16, wherein the advisory message includes the vehicle heading and at least one other vehicle parameter.

18. The method of claim 16, wherein determining if the host vehicle is on a highway includes using data from a vehicle navigation system.

19. The method of claim 16, wherein determining if the host vehicle provides a hazardous condition includes determining if the host vehicle is stopped or the transmission of the host vehicle is in park.

20. The method of claim 16, wherein determining if the host vehicle provides a hazardous condition includes determining if an airbag has deployed in the host vehicle.

21. The apparatus of claim 13, the electronic circuit being further operable to use the received signal strength of the received advisory message to determine a closest passing point of the host vehicle relative to the source of the received advisory message.

* * * * *

UNITED STATES PATENT AND TRADEMARK OFFICE

CERTIFICATE OF CORRECTION

PATENT NO. : 7,427,929 B2
APPLICATION NO. : 11/548419
DATED : September 23, 2008
INVENTOR(S) : James Anthony Bauer et al.

It is certified that error appears in the above-identified patent and that said Letters Patent is hereby corrected as shown below:

Column 4, line 38, replace “quantity” with --quantify--

Column 7, line 2, replace “HBI” with --HMI--

Signed and Sealed this

Twenty-fourth Day of February, 2009

JOHN DOLL
*Acting Director of the United States Patent and Trademark Office*